US007478997B2

(12) United States Patent
Ishida

(10) Patent No.: US 7,478,997 B2
(45) Date of Patent: Jan. 20, 2009

(54) COMPRESSOR

(75) Inventor: Yoshinori Ishida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 505 days.

(21) Appl. No.: 10/564,001

(22) PCT Filed: Jun. 14, 2005

(86) PCT No.: PCT/JP2005/011205

§ 371 (c)(1),
(2), (4) Date: Jan. 10, 2006

(87) PCT Pub. No.: WO2006/006344

PCT Pub. Date: Jan. 19, 2006

(65) Prior Publication Data

US 2008/0112822 A1 May 15, 2008

(30) Foreign Application Priority Data

Jul. 8, 2004 (JP) ..... 2004-201545

(51) Int. Cl.
*F04B 39/00* (2006.01)

(52) U.S. Cl. ..... 417/372; 92/208

(58) Field of Classification Search ..... 417/372, 417/240, 340, 383, 392, 415, 469, 467, 375, 417/384–388; 92/208, 187; 184/6.6
See application file for complete search history.

(56) References Cited

U.S. PATENT DOCUMENTS 4,004,657 A * 1/1977 Ostrowski ..... 188/71.3
4,488,853 A 12/1984 Benson

FOREIGN PATENT DOCUMENTS

GB 771334 12/1954

OTHER PUBLICATIONS

Patent Abstracts of Japan, vol. 2000, No. 08, Oct. 6, 2000, & JP 2000-145637 A (Matsushita Refrigeration Co., Ltd.), May 26, 2000—cited in the application Abstract; Figure 4.
Patent Abstracts of Japan, vol. 1995, No. 10, Nov. 30, 1995, & JP 07-189900 A (Toyota Autom Loom Works Ltd.), Jul. 28, 1995, Abstract; Figure 1.

* cited by examiner

*Primary Examiner*—Charles G Freay
*Assistant Examiner*—Vikansha S Dwivedi
(74) *Attorney, Agent, or Firm*—Wenderoth, Lind & Ponack, L.L.P.

(57) ABSTRACT

A compressor which includes a piston (150) reciprocating in a cylinder bore (111) provided in a cylinder block. Length of the circumferential surface at the compression load side (160) is made to be longer than that at the anti-compression load side (170), so that area of sliding-contact surface at the compression load side is greater than that at the anti-compression load side. The above configuration is effective to prevent occurrence of wearing due to unsymmetrical contact of piston with cylinder bore. Thus, deterioration in the refrigeration capability and instability of the performance is prevented.

13 Claims, 11 Drawing Sheets

COMPRESSOR

TECHNICAL FIELD

The present invention relates to a compressor used in domestic refrigerator freezer and more specifically, to a compressor piston.

BACKGROUND ART

In the worldwide consciousness about energy conservation, reduction of power consumption in such products as home-use refrigerator freezers and the like appliances is urged. Many of the compressors in these appliances are inverter-controlled and driven at lower operation frequencies. However, improvement in the stability of compressor performance during low speed operation still remains a task to be solved, and improvement in the efficiency is another task.

Conventional compressor technology is described using a compressor disclosed in Japanese Patent Unexamined Publication No. 2000-145637, etc. as the example. The up-down disposition of a compressor's constituent elements is described based on a typical configuration among the conventional compressors.

FIG. 13 shows a vertical cross sectional view of a conventional compressor, FIG. 14 shows a horizontal cross sectional view, and FIG. 15 shows a perspective view of a conventional piston as seen from the above.

As shown in FIG. 13, sealed housing 1 contains refrigerant 15 which is filling the inner space of the housing, oil 2 which is stored at the bottom, motor element 5 consisting of stator 3 and rotor 4 having a built-in permanent magnet, and compression element 6 which is driven by motor element 5.

Compression element 6 is described below.

Crankshaft 9, which is disposed vertically, includes main shaft 7 and eccentric shaft 8. Crankshaft 9 has built-in oil pump 20, which pump is connected through to the top of eccentric shaft 8 via spiral groove 17. An open-end of oil pump 20 at the bottom is dipped in oil 2. Cylinder block 12 supports main shaft 7 so that the shaft can make a free revolution, and has cylinder bore 11 for forming compression chamber 10.

Piston 50 is inserted in cylinder bore 11 for reciprocation. Piston pin 14 of a cylindrical shape is disposed in parallel with eccentric shaft 8, and pin 14 is held in piston-pin hole 51 provided in the piston. Connection structure 13 has major connection hole 33 for insertion of eccentric shaft 8, minor connection hole 31 for insertion of piston pin 14, and rod 32 which couples eccentric shaft 8 with piston 50 via piston pin 14.

FIG. 15 illustrates piston 50 with the end for coupling to crankshaft 9 at this side of a viewer, as seen from above the compressor. Piston 50 has an approximate cylindrical shape, which is symmetrical in terms of the right and left sides. As to the both ends of the piston, the surface which constitutes compression chamber 10, in collaboration with cylinder bore 11, is called piston top surface 52, whereas the other end surface connected with connection structure 13 is called piston skirt surface 53. In FIG. 15, piston skirt surface 53, is at the bottom side of the drawing.

The above-configured compressor operates in the following manner.

When motor element 5 is driven with electric power, rotor 4 starts rotating clockwise (as viewed from above the compressor), causing crankshaft 9 to also rotate. The rotating motion of eccentric shaft 8 is conveyed to piston 50 via connection structure 13 and piston pin 14. Then, connection structure 13 oscillates with respect to piston pin 14, and piston 50 reciprocates within cylinder bore 11. As a result of reciprocating motion of piston 50, refrigerant 15 which is filled in sealed housing 1 is sucked into the inside of compression chamber 10, and is compressed and then discharged to the outside of sealed housing 1. This cycle is repeated.

When crankshaft 9 starts rotating, oil pump 20 starts sucking oil 2 and the oil is brought upward through spiral groove 17. The oil is jet-scattered from the top end of eccentric shaft 8 to lubricate such sliding surfaces as a surface between minor connection hole 31 of connection structure 13 and piston pin 14 and a surface between piston 50 and cylinder bore 11.

The above-described conventional hermetic compressors, however, sometimes exhibit unsymmetrical wear at a surface of sliding-contact between piston 50 and cylinder bore 11, which are the constituent parts of compression element 6, when used in the refrigeration system of home-use refrigerator freezers which may be operated at a low revolution speed (for example, at an operation frequency of 1500 r/min).

The inventor of the present invention tested a conventional hermetic compressor driven at low operation speed to observe the posture of piston 50 in cylinder bore 11. It was found that the surface of sliding-contact had unsymmetrical wear. The wear began from a point in the right portion of piston skirt surface 53, as viewed from above the compressor with crankshaft 9 at this side of a viewer, with respect to a vertical plane containing the center axis of piston 50 (viz. point L in FIG. 15), and a point in the left portion of piston top surface 52 (viz. point H in FIG. 15). Namely, piston 50 in a tilt posture was colliding against cylinder bore 11.

When the wear due to contact develops, a gap is generated between piston 50 and cylinder bore 11, which leads to a leakage of refrigerant 15 during the sucking and compression cycle. This invites instability and/or deterioration in the performance of a compressor, making it difficult to guarantee the operational reliability for a long-time.

On the other hand, when an anti-wearing measure was tried with piston 50 and cylinder bore 11 by means of the mechanical design, material used, etc., the complexity in the structure waa increased, thereby increasing manufacturing cost and the like.

DISCLOSURE OF INVENTION

In a compressor in accordance with the present invention, a surface area of sliding-contact formed between the piston and the cylinder bore is made to be greater at the compression load side than that at the anti-compression load side; thus, the sliding resistance due to fluid friction at the compression load side is increased. In this manner, the increased sliding resistance cancels out the counter-clockwise oscillation moment of the piston caused by friction between a piston pin and connection structure. As a result, the piston can maintain a straight posture in the cylinder bore. The wear due to a unsymmetrical collisions between the piston and the cylinder bore can be prevented.

Since the present invention offers means to prevent the occurrence of unsymmetrical wear of the piston and cylinder bore, it is advantageous in implementing high reliability compressors at low cost.

DETAILED DESCRIPTION OF THE INVENTION

Figure 1:
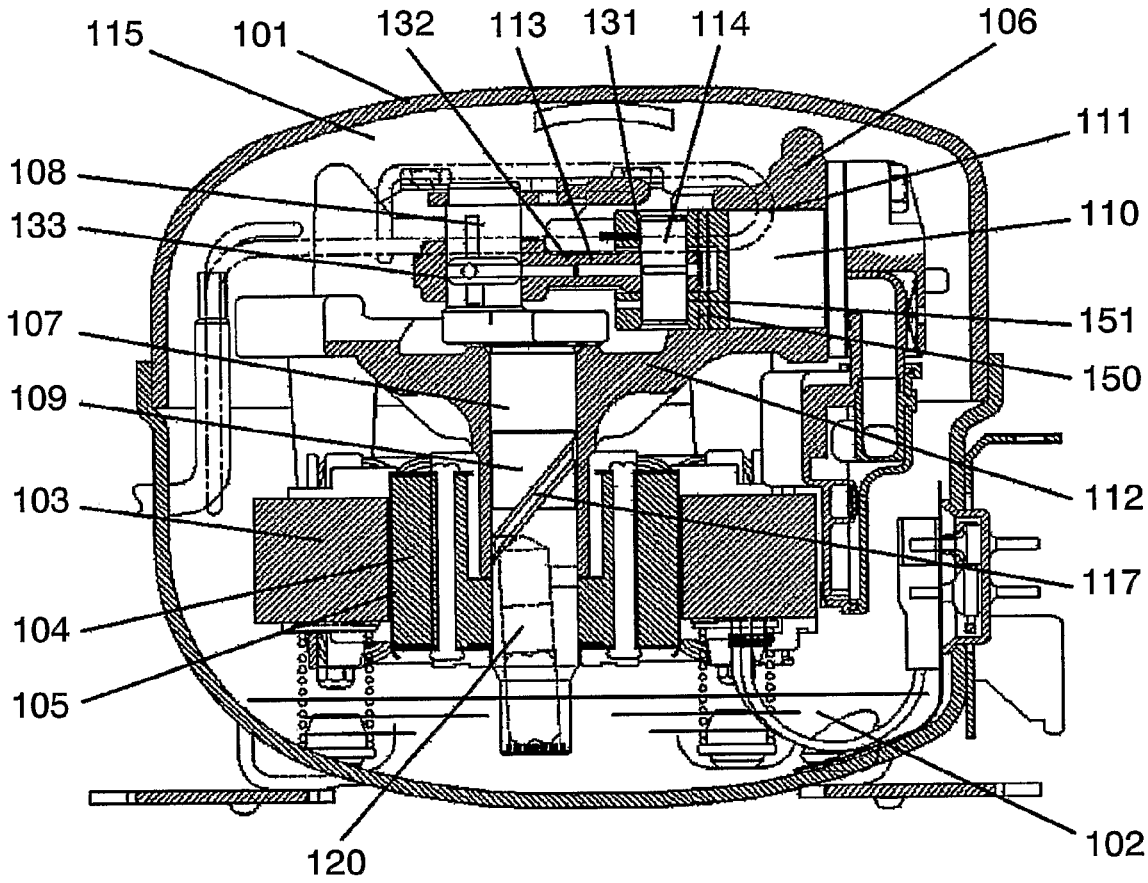
FIG. 1 shows a vertical cross sectional view of a compressor in accordance with a first exemplary embodiment of the present invention.

A compressor in accordance with the present invention includes a motor element having a stator and a rotor, and a compression element driven by the motor element; these elements are contained in a sealed housing which stores oil. The compression element includes a crankshaft formed of a main shaft and an eccentric shaft, a cylinder block which supports the main shaft so that the shaft can revolve freely and provided with a cylinder bore for a compression chamber, a piston which reciprocates within the cylinder bore, and a connection structure for connecting the piston with the eccentric shaft. An Area of sliding-contact between the piston and the cylinder bore at the compression load side is greater than that at the anti-compression load side.

The compression load side and the anti-compression load side are as follows:

The connection structure undergoes an oscillation motion with respect to the piston. Imagine a reference plane that is perpendicular to the connection structure's oscillation plane and includes a center axis of the piston. A side of the circumferential surface which does not share the same zone, in relation to the reference plane, with the connection structure at its compression stroke is called the compression load side; whereas, the opposite side of the circumferential surface is called the anti-compression load side.

The circumferential surface at the compression load side is pressed stronger against the cylinder bore wall, as compared with that at the anti-compression load side, by a force imported to the piston during the compression stage.

By increasing the sliding resistance due to fluid friction at the compression load side, a counter-clockwise oscillation moment of the piston due to a friction between the piston pin and the connection structure can be canceled, and the piston can maintain a straight posture in the cylinder bore. Thereby, wear caused by an unsymmetrical contact with the piston and the cylinder bore is prevented. Thus the present invention is advantageous in implementing compressors of high reliability at low cost.

A piston in accordance with the present invention has a length of the circumferential surface that is longer at the compression load side in relation to that at the anti-compression load side. Since the outline shape of a piston is mostly determined by the shape of a mold, the piston in accordance with the present invention does not require a post-processing for providing a difference in the area of the sliding-contact surface between the right and the left. Thus, pistons are configured for volume production, and high reliability compressors can be offered at low cost.

A piston in accordance with the present invention is provided in the circumferential surface with a hollow area of no sliding-contact. The hollow area of no sliding-contact contributes to reduce sliding resistance due to fluid friction, and to lower the compressor input. Thus the present invention offers an advantage in implementing reliable compressors at low cost.

A piston in accordance with the present invention is provided in the circumferential surface with an area of no sliding-contact, leaving the surface of sliding-contact at least at the ends of the piston top surface and at the piston skirt surface. This means that the final polishing of the sliding-contact surface can be carried out by using a centerless grinder, and the production efficiency is high. Thus, compressors of high reliability can be offered at low cost.

A piston in accordance with the present invention is provided with the sliding-contact surface at the compression load side and the sliding-contact surface at the anti-compression load side; respective surfaces extend along the direction of piston reciprocation, and the width of the surface at the compression load side is made to be wider than that at the anti-compression load side. Since the sliding-contact surface at the compression load side is not split by an area of no sliding-contact, oil film existing along the sliding-contact surface at the compression load side is not damaged easily even if the pressure in the compression chamber becomes high due to a high pressure refrigerant or other operating conditions within the system. Thus the present invention offers an advantage of implementing those high reliability compressors at low cost.

Compressors in the present invention may be put into operation at frequencies including at least those which are even lower than normally available commercial power supply frequency. The compressor input can be suppressed to be low and the right posture of the piston can be maintained for a long time with good stability; these factors altogether contribute to lower the power consumption and implement refrigerant compressors of high reliability.

Now in the following, exemplary embodiments of the present invention are described referring to the drawings. It is to be noted that these embodiments are exemplary; they should not be interpreted to limit the scope of the present invention.

First Exemplary Embodiment

Figure 2:
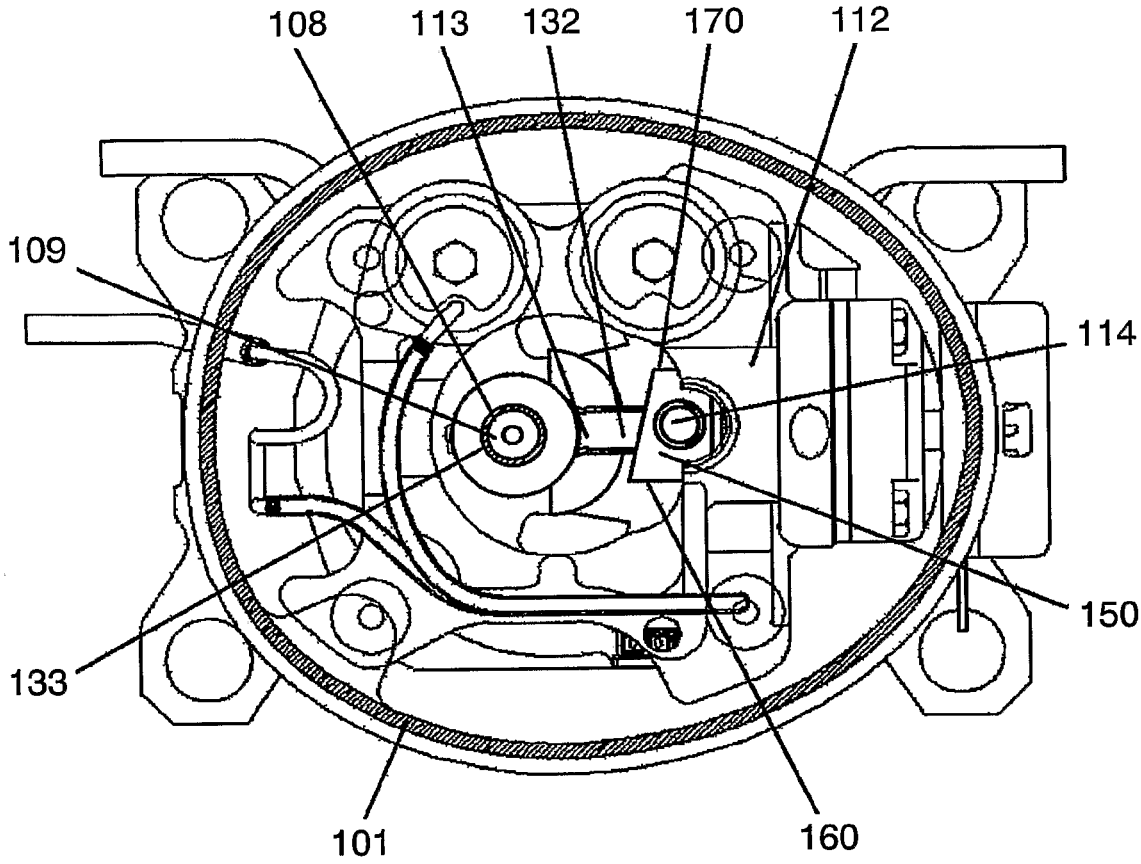
FIG. 2 shows a horizontal cross sectional view of a compressor in accordance with the first embodiment.
Figure 3:
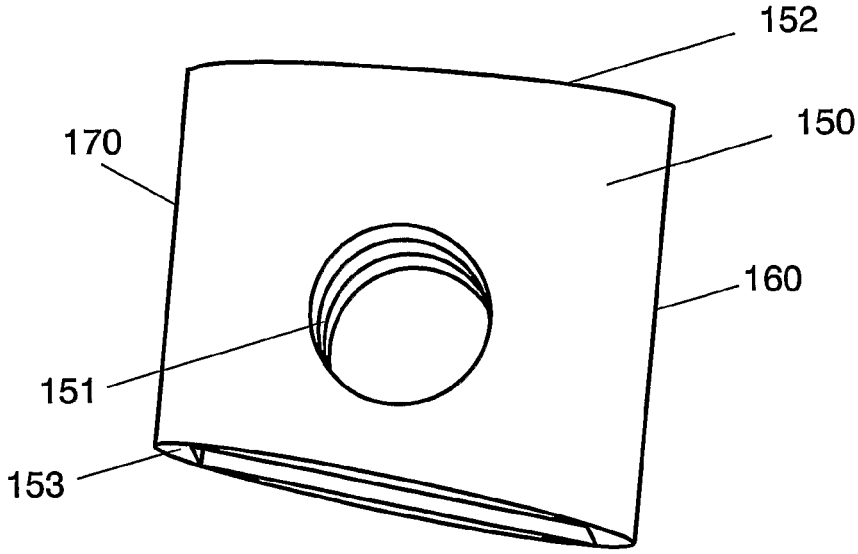
FIG. 3 is a perspective view of a piston in the first embodiment, as seen from the above.
Figure 4:
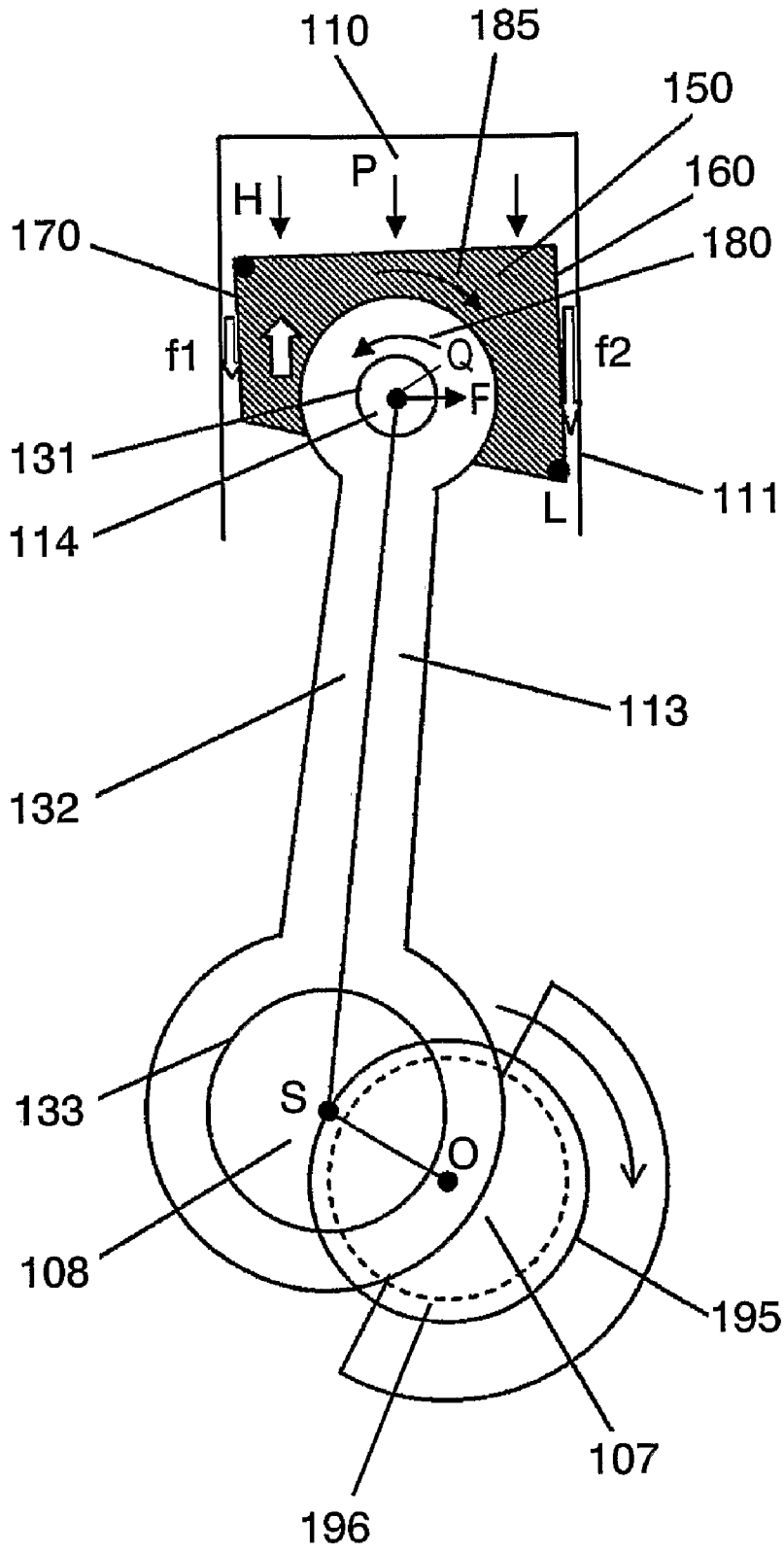
FIG. 4 is an illustration used to describe the operating behavior of a piston in the first embodiment.

A compressor in accordance with the first embodiment of the present invention is described referring to the following drawings: FIG. 1 shows a vertically cross sectional view, FIG. 2 shows a horizontally cross sectional view, FIG. 3 shows perspective view of a piston, seen from above, and FIG. 4 shows an operating behavior of the piston.

Sealed housing 101 is filled with refrigerant 115, such as isobutane (R600a), and stores oil 102, such as a relatively low viscosity mineral oil, at the bottom.

Motor element 105 is fixed to the lower part of cylinder block 112. The motor element 105 is an inverter-control motor which comprises stator 103 coupled with an inverter circuit (not shown), and rotor 104 having a built-in permanent magnet and fixed to the lower part of main shaft 107. The inverter circuit drives motor element 105 at a plurality of operation frequencies including those lower than the commercially available power supply frequency (e.g. 1500 r/min).

Compression element 106 is described below.

Vertically-disposed crankshaft 109 is formed of main shaft 107 and eccentric shaft 108. Main shaft 107 has built-in oil pump 120, which pump is connected to the top end of eccentric shaft 108 through spiral groove 117 while the bottom opening is dipped in oil 102. Cylinder block 112 supports main shaft 107 so that the shaft can revolve freely, and is provided with cylinder bore 111 for forming compression chamber 110.

Piston 150 is fitted in cylinder bore 111 so that the piston can reciprocate in the bore. Piston pin 114 has an approximate cylindrical shape, and is disposed in parallel to eccentric shaft 108 so as to be fixed in piston pin hole 151 provided in piston 150. Connection structure 113 has major connection hole 133 provided for insertion of eccentric shaft 108, minor connection hole 131 provided for insertion of piston pin 114, and rod 132 which connects eccentric shaft 108 with piston 150 by means of piston pin 114.

In the drawings of the compressor in the present embodiment, as viewed from above with crankshaft 109 at this side of a viewer, a side of the circumferential surface of piston 150 at the right in relation to a vertical cross sectional plane containing the center axis of the piston cylinder (viz. a flat plane that is parallel to the center axis) represents compression load side 160, while that at the left is anti-compression load side 170.

In the present embodiment, the length of the circumferential surface in the reciprocation direction of piston 150 is made to be longer at compression load side 160 than that at anti-compression load side 170. By so doing, the area of sliding-contact surface at the compression load side becomes greater than that at the anti-compression load side.

A surface of piston 150 which forms compression chamber 110 in collaboration with cylinder bore 111 is called piston top surface 152, whereas the other end of piston 150 at which connection structure 113 is coupled for a rotary connection is called piston skirt surface 153. When viewed from above the center axis of round piston pin hole 151, piston top surface 152 and piston skirt surface 153 are not parallel to each other. In the present example, piston top surface 152 is perpendicular to center axis of piston 150, while the piston skirt surface 153 deviates from a plane which is perpendicular to the center axis.

Many of the above-described sliding components of compression element 106 are made of a cast iron, a sintered iron, a carbon steel or the like material including iron. Connection structure 113, however, is formed with an aluminum-containing material, which is compatible with iron, for example an aluminum die cast, in view of the anti-wearing property thereof.

Operation of the above-configured compressor is described in the following.

As soon as motor element 105 is driven with electric power, rotor 104 starts revolving clockwise (as viewed from above the compressor), and crankshaft 109 revolves likewise. The revolution of eccentric shaft 108 is conveyed to piston 150 by way of connection structure 113 and piston pin 114, connection structure 113 oscillates (or, undergoes a pendulum action) with respect to piston pin 114, and piston 150 reciprocates in cylinder bore 111. As the result of reciprocation of piston 150, refrigerant 115 filling the inside of sealed housing 101 is sucked into compression chamber 110 and then compressed to be discharged to the outside of sealed housing 101. The compression and discharge cycle repeats.

When crankshaft 109 revolves, oil pump 120 sucks oil 102 and the oil is carried upward via spiral groove 117 to be jet-scattered from the top end of eccentric shaft 108. Oil 102 thus scattered lubricates sliding surfaces such as surfaces between minor connection hole 131 and piston pin 114, and surfaces between piston 150 and cylinder bore 111.

Next described, referring to FIG. 4, is the behavior of piston 150 during the latter stage of a compression stroke; the posture of piston 150 is considered to deteriorate at this stage. FIG. 4 shows the compression element as viewed from above, with eccentric shaft 108 disposed at this side of a viewer. Main shaft 107 revolves clockwise on center axis O. Point S indicates the center axis of eccentric shaft 108, point Q the center axis of piston pin 114, circle 195 represents the locus of center axis S of eccentric shaft 108, and dotted line circle 196 indicates outer diameter of main shaft 107.

Piston 150 is under the influence of compression force P. Along with counter-clockwise revolution at minor connection hole 131, a substantial counter-clockwise oscillation moment 180 is generated as indicated with an arrow mark. Meanwhile, due to the lateral vector F of compression force P, the sliding resistance f2 caused by fluid friction between circumferential surface of piston 150 at the compression load side 160 and cylinder bore 111 becomes greater than the sliding resistance f1 which is caused by fluid friction between the circumferential surface at the anti-compression load side 170 and cylinder bore 111. As the result, clockwise oscillation moment 185, which is a moment that is opposite to counter-clockwise oscillation moment 180, arises. In the present embodiment, the circumferential surface at compression load side 160 is a side of the circumferential surface which is opposite to the side where connection structure 113 undergoes pendulum action with respect to piston 150 in a compression stroke.

In the conventional compressors, where the circumferential surface at compression load side 160 and that at anti-compression load side 170 have the same length, counter-clockwise oscillation moment 180 is greater than clockwise oscillation moment 185. Therefore, piston 150 is eventually affected by the counter-clockwise oscillation moment. As the result, piston 150 exhibits a leftward tilt in cylinder bore 111, and the circumferential surface of piston 150 collides with cylinder bore 111 at the points corresponding to L and H. This collision contact is considered to generate wear.

On the other hand, piston 150 in the present embodiment the circumferential surface at compression load side 160 has a longer length than that at anti-compression load side 170. Under the above configuration, the sliding resistance f2 caused by fluid friction between the circumferential surface at compression load side 160 and cylinder bore 111 becomes greater than the sliding resistance f1 caused by fluid friction between the circumferential surface at anti-compression load side 170 and cylinder bore 111. As the result, clockwise oscillation moment 185 becomes greater, bringing about equilibrium with counter-clockwise oscillation moment 180.

Namely, clockwise oscillation moment 185 cancels counter-clockwise oscillation moment 180. There is no oscillation moment which affects piston 150; so, it is considered that a leftward tilted posture of the piston disappears because of this. Thus, piston 150 can maintain the straight posture in cylinder bore 111 during low speed operation. The wearing phenomenon resulting from unsymmetrical mechanical contact of piston 150 against cylinder bore 111, which mechanical contact starts at the points of sliding surface corresponding to L and H, is thus prevented.

Referring to FIG. 4, connection structure 113 resides to the left in relation to a reference plane, which plane is perpendicular to an oscillation plane of connection structure 113 and includes the center axis of piston 150. Namely, connection structure 113 at its compression stroke (viz. the piston is on the way from the bottom dead point to the top dead point) is to the left of the above-described reference plane; so, the circumferential surface at compression load side in the present embodiment is surface 160. By making the area of a sliding-contact surface of the piston at the compression load side greater than that at the anti-compression load side 170, the posture of piston 150 in cylinder bore 111 is maintained substantially straight during low speed operation.

In the experiment conducted by the inventors using actually operating test compressors, damage due to the unsymmetrical contact with cylinder bore 111 was hardly observed on the surface of piston 150 in the present embodiment. Furthermore, comparative testing was conducted between compressors in the present embodiment and conventional ones with respect to a number of performance values at low speed operation, among other speeds. In the test, compressors in the present embodiment exhibited improvements in the average values at each of the performance values, and dispersion of the values decreased more than 20%.

As described in the above, the wearing due to unsymmetrical contact of piston 150 with cylinder bore 111 can be prevented in accordance with the present embodiment. The efficiency of compressors at low speed operation can be raised, and the performance stabilized. Thus the present invention is advantageous in offering reliable compressors at low cost.

Ratio in the length of piston 150 at compression load side 160 vs. the length at anti-compression load side 170 may be optimized according to the conditions in revolution frequencies, pressure requirements, etc. presented from the system designing side.

Although the above descriptions have been based on the generally prevailing structure that compression element 106 is disposed above motor element 105, the present invention may of course be embodied also in an opposite setup.

Second Exemplary Embodiment

Figure 5:
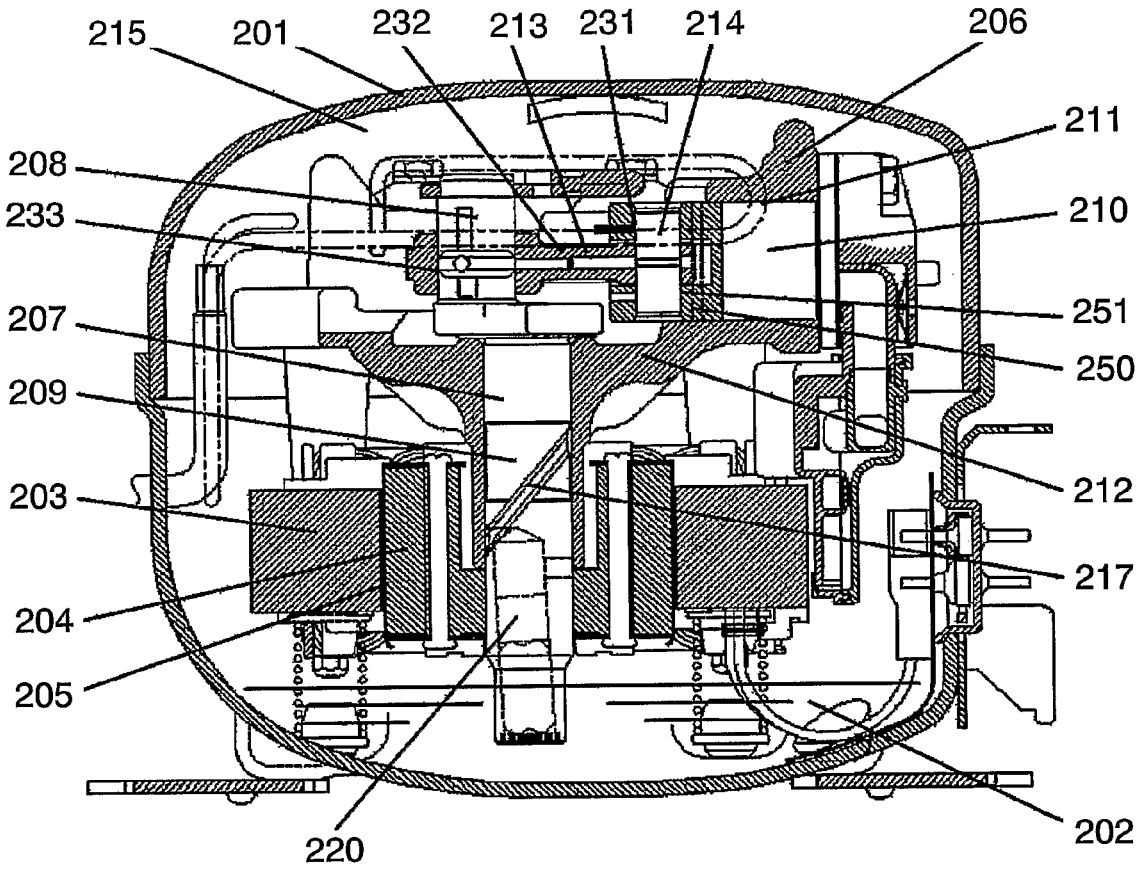
FIG. 5 is a vertical cross sectional view of a compressor in accordance with a second embodiment of the present invention.
Figure 6:
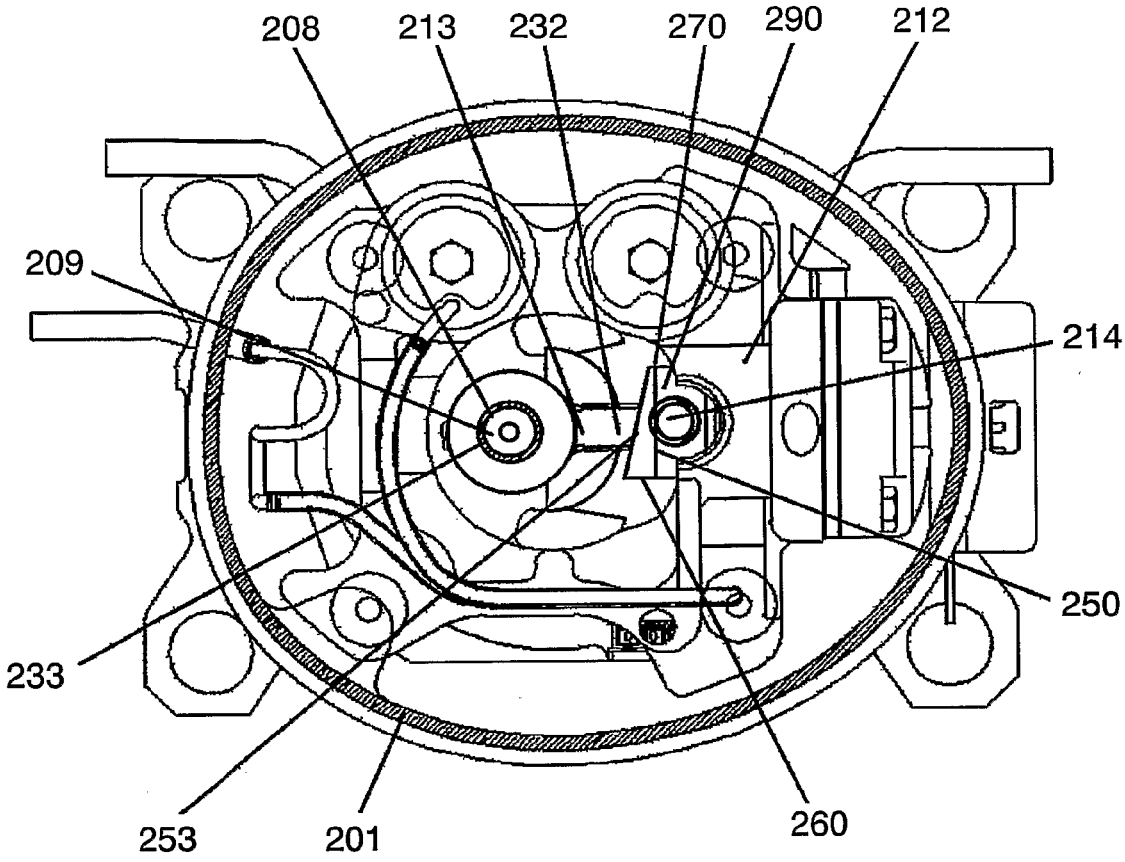
FIG. 6 is a horizontal cross sectional view of a compressor in accordance with the second embodiment.
Figure 7:
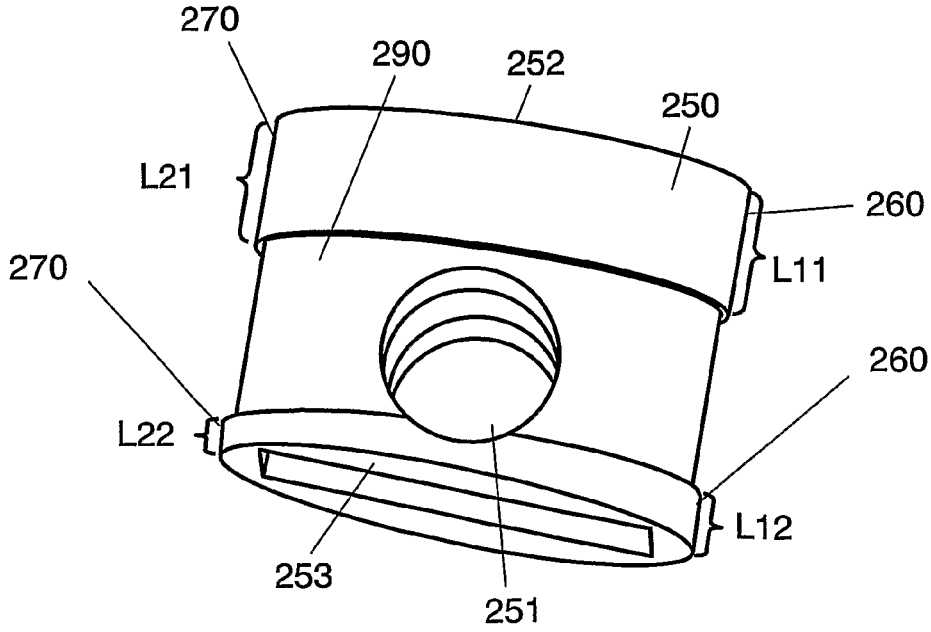
FIG. 7 shows a perspective view of a piston in the second embodiment, as seen from above.
Figure 8:
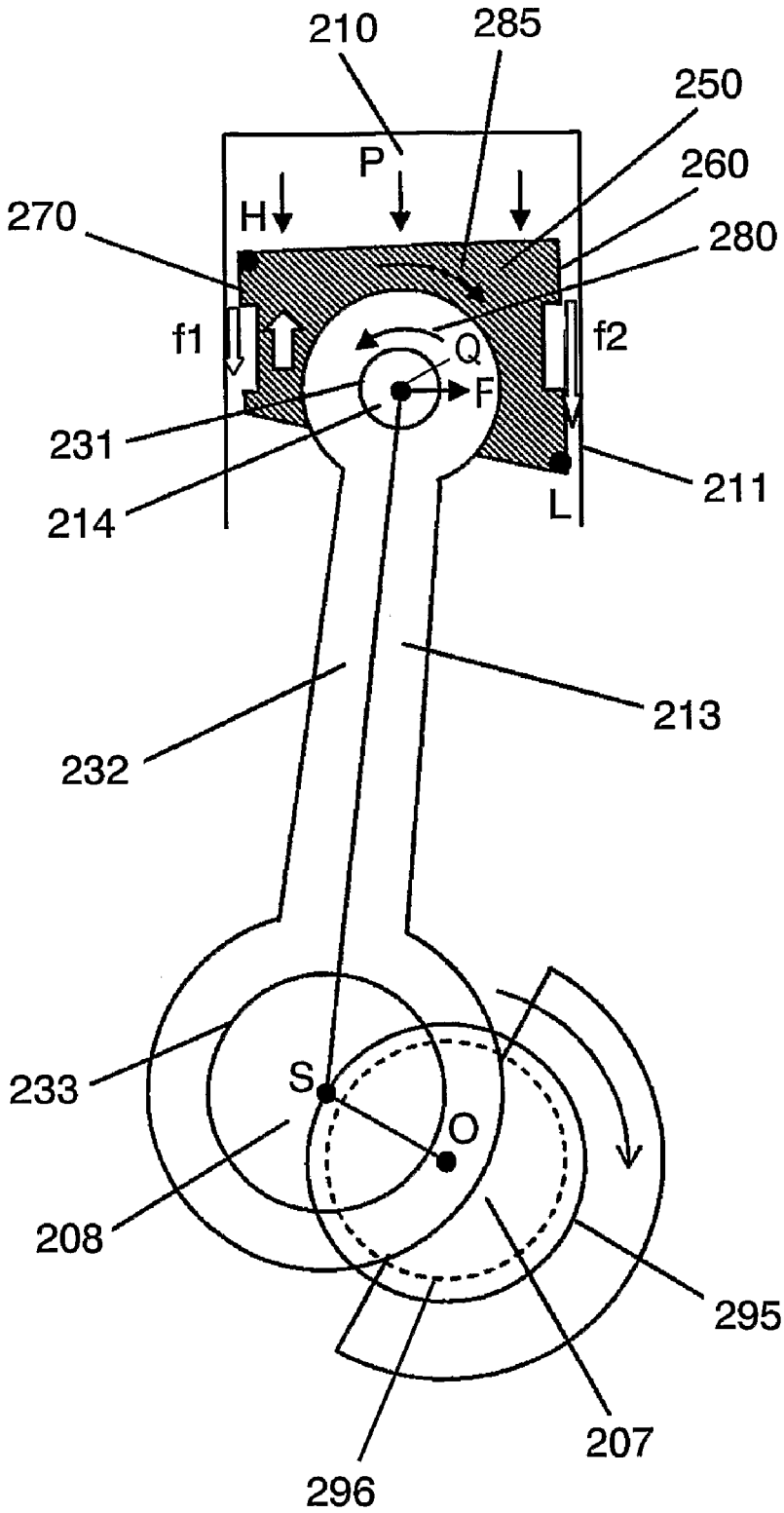
FIG. 8 is an illustration used to describe the operating behavior of a piston in the second embodiment.

A compressor in accordance with the second embodiment of the present invention is described referring to the following drawings: FIG. 5 shows a vertically cross sectional view, FIG. 6 shows a horizontally cross sectional view, FIG. 7 shows a perspective view of a piston, seen from above, and FIG. 8 shows an operating behavior of the piston.

Sealed housing 201 is filled with refrigerant 215, or isobutane (R600a), and stores oil 202, or a relatively low viscosity mineral oil, at the bottom.

Motor element 205 is fixed to the lower part of cylinder block 212. The motor element is an inverter-control motor which comprises stator 203 coupled with an inverter circuit (not shown), and rotor 204 having a built-in permanent magnet and fixed to the lower part of main shaft 207. The inverter circuit drives motor element 205 at a plurality of operation frequencies including those lower than the commercially available power supply frequency (e.g. 1500 r/min).

Compression element 206 is described below.

Vertically-disposed crankshaft 209 is formed of main shaft 207 and eccentric shaft 208. Crankshaft 209 has built-in oil pump 220, which pump is connected through to the top end of eccentric shaft 208 via spiral groove 217, while the bottom opening is dipped in oil 202. Cylinder block 212 supports main shaft 207 so that the shaft can revolve freely, and is provided with cylinder bore 211 for forming compression chamber 210.

Piston 250 is fitted in cylinder bore 211 so that the piston can reciprocate therein. Piston pin 214 of an approximate cylindrical shape is disposed in parallel to eccentric shaft 208 to be fitted in piston pin hole 251 provided in piston 250. Connection structure 213 has major connection hole 233 provided for insertion of eccentric shaft 208, minor connection hole 231 provided for insertion of piston pin 214, and rod 232 which connects eccentric shaft 208 with piston 250 by means of piston pin 214.

In the drawings of a compressor in the present embodiment, as viewed from the above with crankshaft 209 at this side of a viewer, a side of the circumferential surface of piston 250 at the right in relation to a vertical cross sectional plane containing the center axis of a piston cylinder (viz. a flat plane that is parallel to the center axis) represents compression load side 260, while the surface at the left is anti-compression load side 270. Among the two ends of the piston, the surface that forms compression chamber 210 in collaboration with cylinder bore 211 is called piston top surface 252, whereas the other end at which connection structure 213 is inserted for accomplishing a rotary connection is called piston skirt surface 253. The circumferential surface of piston 250 in the present embodiment is provided with a sliding-contact surface having sliding-contact surface portions at the edge of piston top surface 252 and at the edge of piston skirt surface 253, respectively. Each of the sliding-contact surface portions being formed from the respective circumferential edges for its own specific width. Namely, between the sliding-contact surfaces (i.e., surface portions) is an area of no sliding-contact 290, and the diameter of the area of no sliding-contact 290 is smaller than the diameter of the sliding-contact surfaces (i.e., surface portions). Sum (L11+L12) in the length of sliding-contact surfaces at compression load side 260 is made to be greater than sum (L21+L22) at anti-compression load side 270. As the result, the area of the sliding-contact surface at compression load side 260 is greater than that at anti-compression load side 270.

In other words, as viewed from above the center axis of round piston pin hole 251, piston top surface 252 and that representing piston skirt surface 253 are not in parallel to each other. In this example, piston top surface 252 is perpendicular to the center axis of the piston cylinder, while piston skirt surface 253 deviates from the perpendicular plane.

Many of the above-described sliding components of compression element 206 are made of a cast iron, a sintered iron, a carbon steel or the like material including iron. Connection structure 213, however, is formed with an aluminum-containing material, which is compatible with iron, for example an aluminum die cast, in view of the anti-wearing property thereof.

Operation of the above-configured compressor is described in the following.

As soon as motor element 205 is driven with electric power, rotor 204 starts revolving clockwise (as viewed from above the compressor), and crankshaft 209 revolves likewise. The revolving motion of eccentric shaft 208 is conveyed by way of connection structure 213 and piston pin 214 to piston 250, connection structure 213 oscillates with respect to piston pin 214, and piston 250 exhibits reciprocating motion in cylinder bore 211. As the result of reciprocation of piston 250, refrigerant 215 filling the inside of sealed housing 201 is sucked into compression chamber 210 and then compressed to be discharged to the outside of sealed housing 201. The compression and discharge cycle repeats.

When crankshaft 209 revolves, oil pump 220 sucks oil 202 and sends it upward through spiral groove 217 to be scattered from the top end of eccentric shaft 208. Oil 202 thus scattered lubricates sliding surfaces such as surfaces between minor connection hole 231 and piston pin 214, and surfaces between piston 250 and cylinder bore 211.

Now, the behavior of piston 250 in accordance with the present embodiment is described referring to FIG. 8. The posture of piston 250 is considered to deteriorate at the latter stage of a compression stroke. FIG. 8 shows the compression element as viewed from above, with eccentric shaft 208 at this side of a viewer. Main shaft 207 revolves clockwise on its center axis O. Point S represents the center axis of eccentric shaft 208, point Q the center axis of piston pin 214, circle 295 represents the locus of center axis S of eccentric shaft 208, and dotted line circle 296 represents the outer diameter of main shaft 207.

Piston 250 is under the influence of compression force P. Along with counter-clockwise revolution at minor connection hole 231, a substantial counter-clockwise oscillation moment 280 is generated as indicated with an arrow mark. Meanwhile, due to the lateral vector F of compression force P, the sliding resistance f2 caused by fluid friction between the circumferential surface of piston 250 at the compression load side 260 and cylinder bore 211 becomes greater than the sliding resistance f1 which is caused by fluid friction between the circumferential surface at the anti-compression load side 270 and cylinder bore 211. As the result, clockwise oscillation moment 285, which is a moment that is opposite to counter-clockwise oscillation moment 280, arises.

In the conventional compressors, where the area of the circumferential surface at the compression load side and that at the anti-compression load side are identical, and counter-clockwise oscillation moment 280 is greater than clockwise oscillation moment 285. Therefore, piston 250 is eventually affected by the counter-clockwise oscillation moment. As the result, piston 250 exhibits a leftward tilt in cylinder bore 211, and circumferential surface of piston 250 collides with cylinder bore 211 at the points corresponding to L and H. The collision contact is considered to generate the wear.

On the other hand, in piston 250 in the present embodiment where the circumferential surface has been split by the area of no sliding-contact 290, sum (L11+L12) of the lengths of sliding-contact surfaces (i.e., surface portions) at the compression load side 260 is made to be greater than sum (L21+L22) at anti-compression load side 270. Under the above-described configuration, the sliding resistance f2 due to fluid friction between the sliding-contact surface at compression load side 260 and cylinder bore 211 becomes greater than the sliding resistance f1 which is due to fluid friction between sliding-contact surface at anti-compression load side 270 and cylinder bore 211. As the result, clockwise oscillation moment 285 is increased to bring about equilibrium with counter-clockwise oscillation moment 280.

Namely, clockwise oscillation moment 285 cancels counter-clockwise oscillation moment 280. There is no oscillation moment which affects piston 250; so, it is considered that the leftward tilted posture of the piston disappears because of this. Thus, piston 250 can maintain the straight posture in cylinder bore 211 during low speed operation. The wearing phenomenon resulting from unsymmetrical mechanical contact of piston 250 against cylinder bore 211, which mechanical contact is starts at the points of the sliding surface corresponding to L and H, is thus prevented.

In the experiment conducted by the inventors using actually operating test compressors, damage due to the unsymmetrical contact with cylinder bore 211 was hardly observed on surface of piston 250 in the present embodiment. Furthermore, comparative testing was conducted between compressors in the present embodiment and conventional ones with respect to a number of performance values at low speed operation, among other speeds. In the test, compressors in the present embodiment showed improvements in the average values at each of the performance values, and dispersion of the values decreased for more than 40%.

As described above, during the compression stroke (viz. the piston is on the way from the bottom dead point to the top dead point), connection structure 213 is located in the left in relation to a reference plane which is perpendicular to the plane of pendulum action of connection structure 213 and is including center axis of piston 250. So, surface 260 represents the surface at the compression load side. By making the area of a sliding-contact surface of the piston at the compression load side 260 to be greater than that at the anti-compression load side 270, the posture of piston 250 in cylinder bore 211 can be maintained substantially straight during low speed operation, and the wear due to unsymmetrical contact of piston 250 with cylinder bore 211 can be avoided. Thus the efficiency at slow speed operation can be raised and the performance stabilized. The present invention is advantageous in offering those high reliability compressors at low cost.

Furthermore, the circumferential surface of piston 250 in the present embodiment is provided with a hollow area, or area of no sliding-contact 290. The sliding resistance due to fluid friction between piston 250 and cylinder bore 211 is lowered for an amount corresponding to the hollow area. Consequently, the compressor input can be suppressed to be low and power consumption can be reduced.

Still further, piston 250 in the present embodiment is provided in the circumferential surface with the area of no sliding-contact 290, leaving the sliding-contact surface adjoining piston top surface 252 and piston skirt surface 253, respectively, with certain individual widths. Therefore, the final finishing of the sliding-contact surfaces of piston 250 can be processed by using a centerless grinder. This means that the piston can be manufactured without requiring a large-scale machining facility, and the piston has high productivity.

In piston 250 of the present embodiment, the ratio of the length in the direction of reciprocation between the sum of sliding-contact lengths at compression load side 260 vs. the sum of lengths at anti-compression load side 270, as well as the resultant length of no sliding-contact area 290, may be optimized according to the conditions in revolution frequency, compression condition, etc. presented from the system designing side.

Although the above descriptions have been based on a typical structure in which compression element 206 is disposed above motor element 205, the present invention may of course be embodied also in an opposite setup.

Third Exemplary Embodiment

Figure 9:
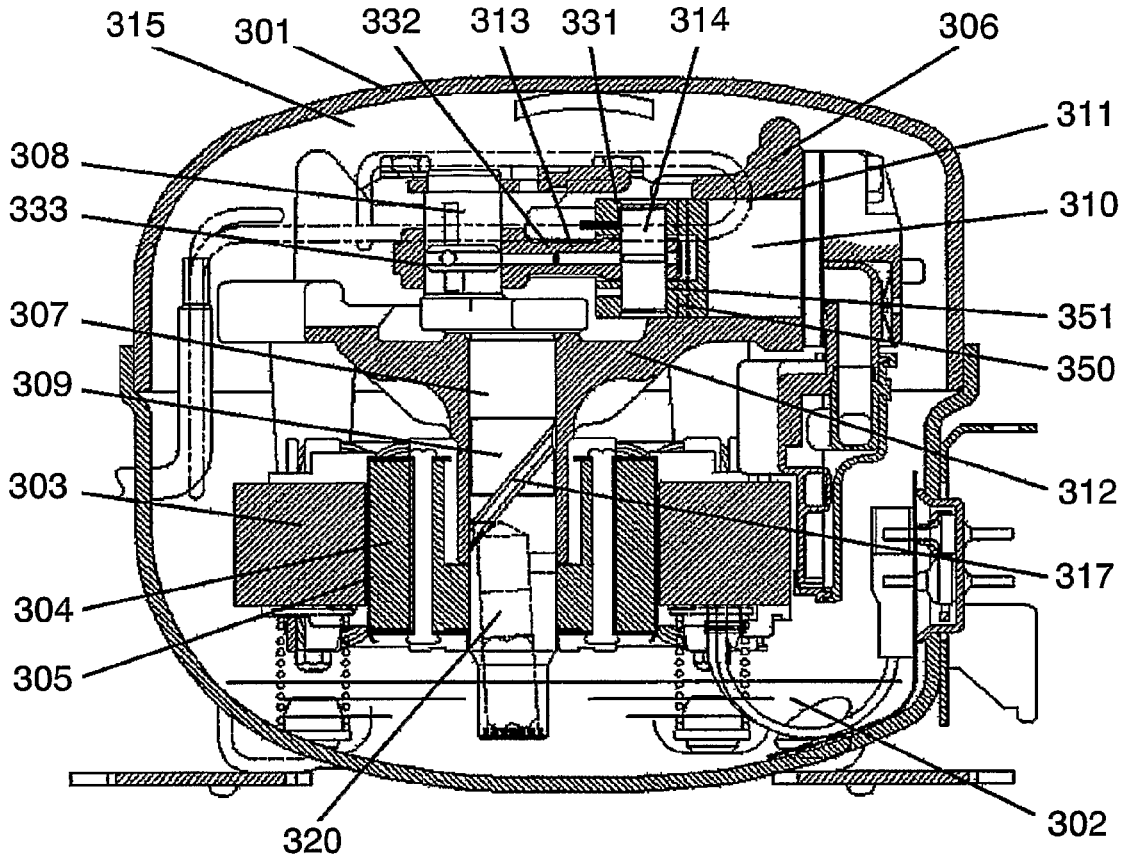
FIG. 9 is a vertical cross sectional view of a compressor in accordance with a third embodiment of the present invention.
Figure 10:
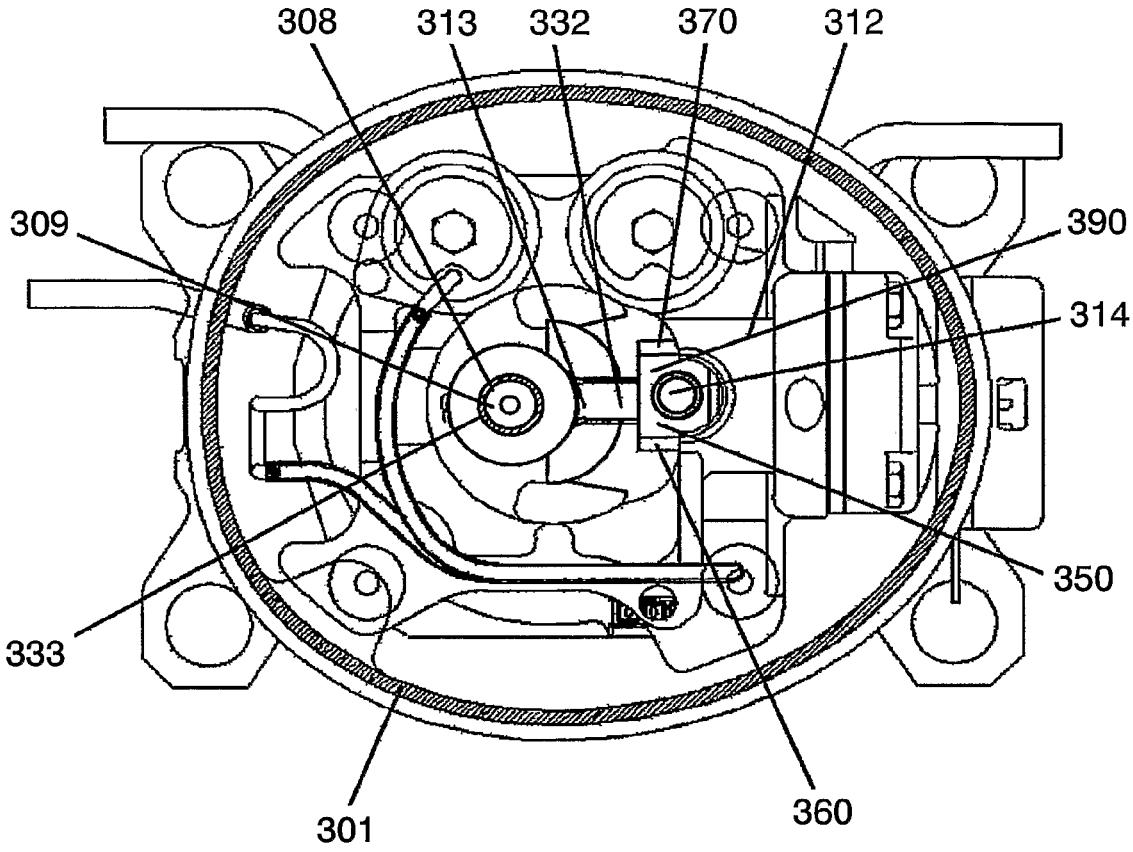
FIG. 10 is a horizontal cross sectional view of a compressor in the third embodiment.
Figure 11:
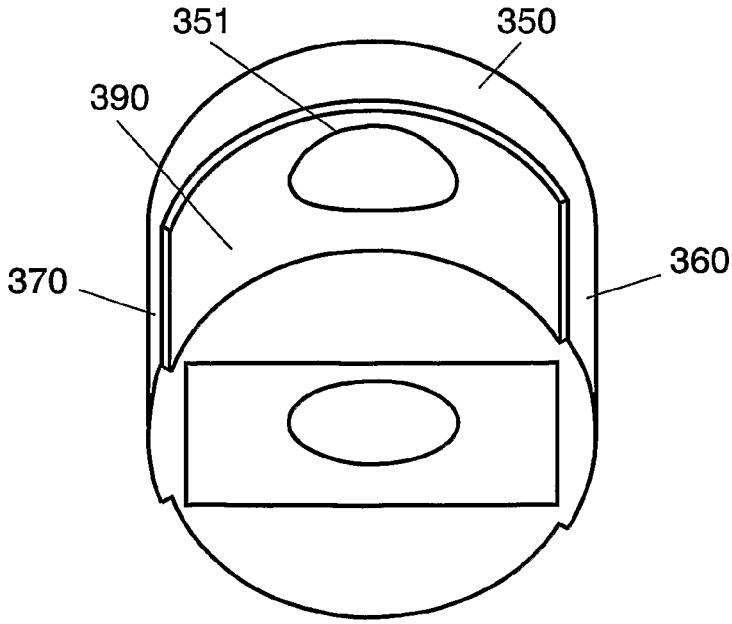
FIG. 11 shows a perspective view of a piston in the third embodiment, as seen from above.
Figure 12:
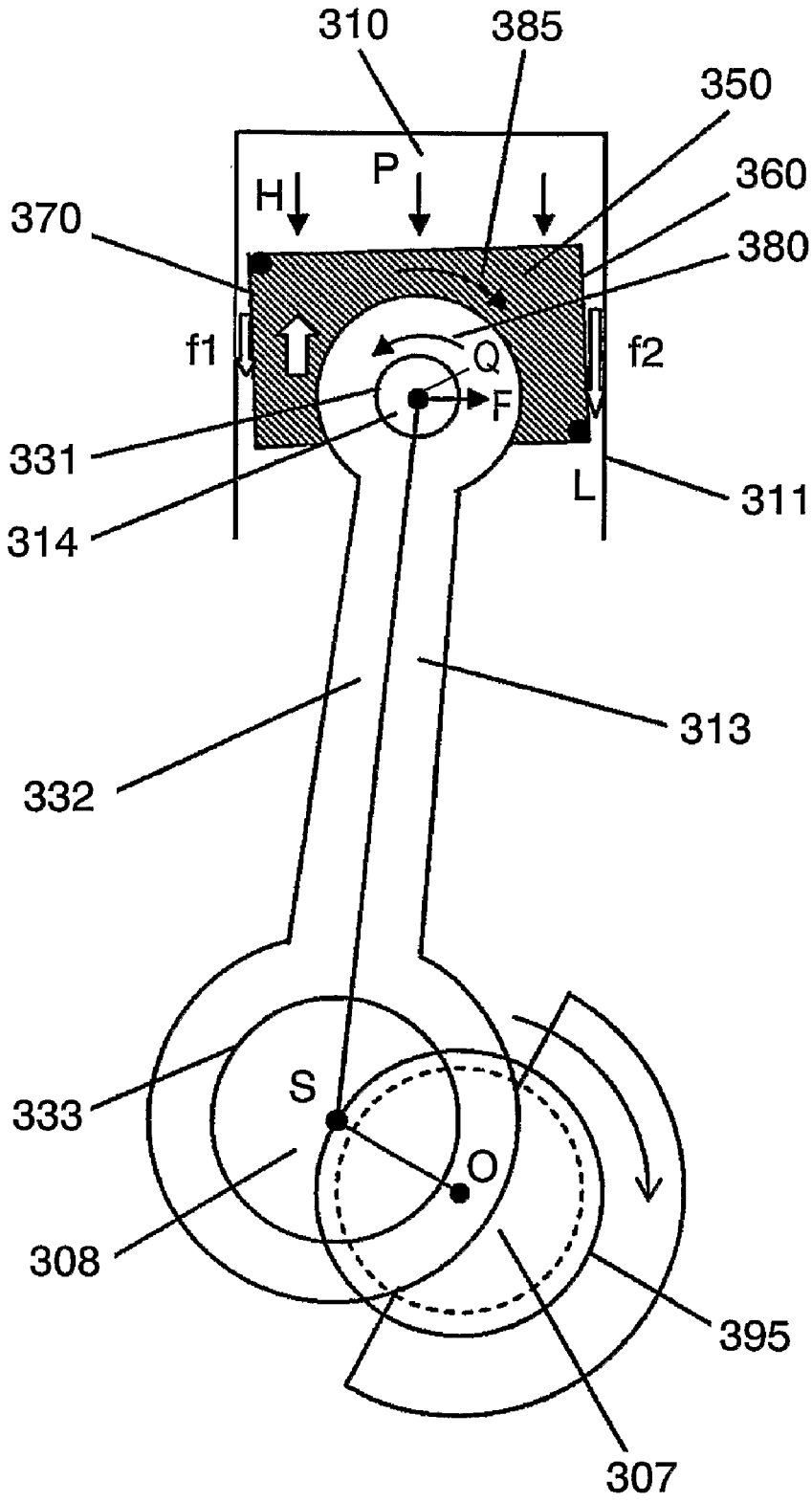
FIG. 12 is an illustration used to describe the operating behavior of a piston in the third embodiment.
Figure 13:
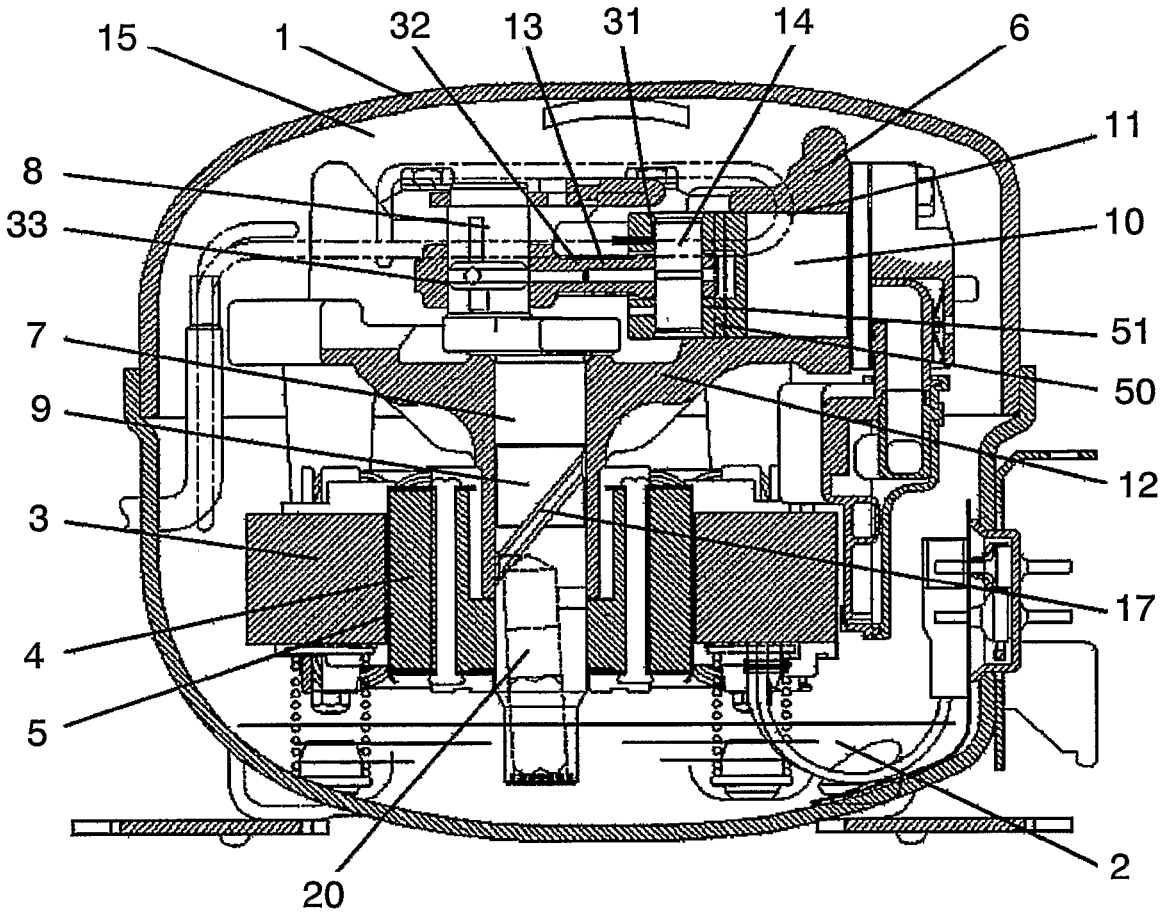
FIG. 13 is a vertical cross sectional view of a conventional compressor.
Figure 14:
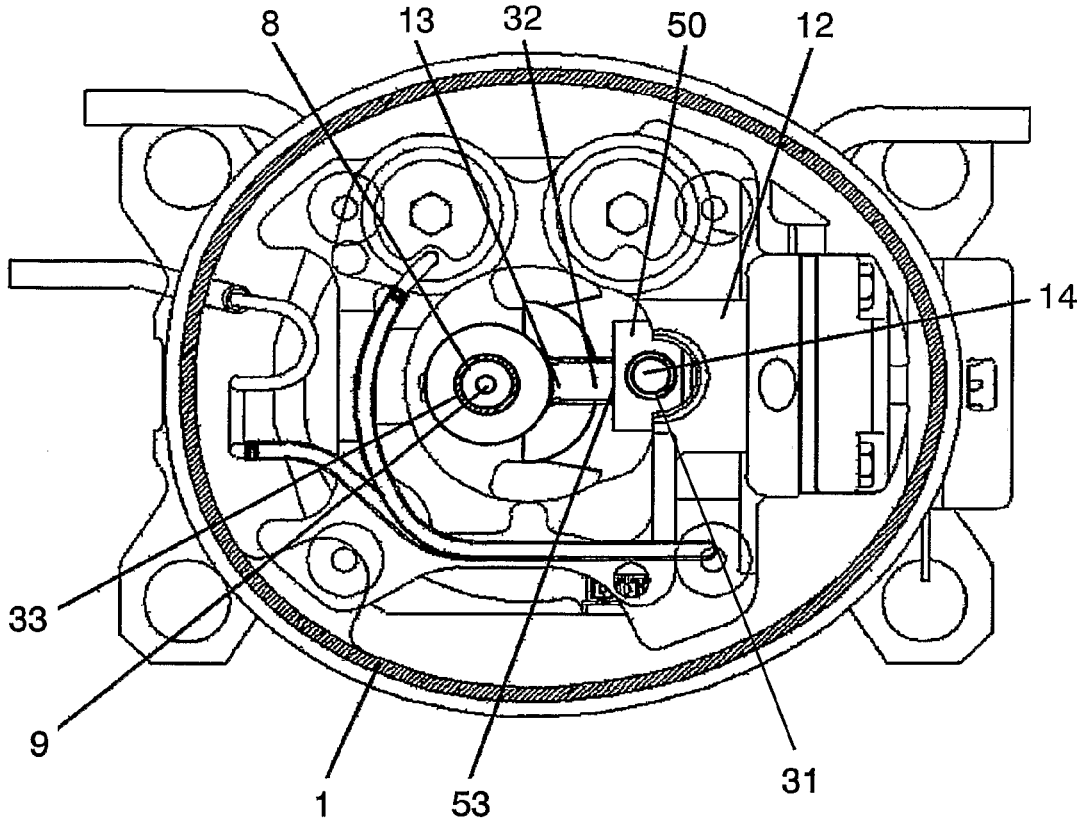
FIG. 14 is a horizontal cross sectional view of a conventional compressor.
Figure 15:
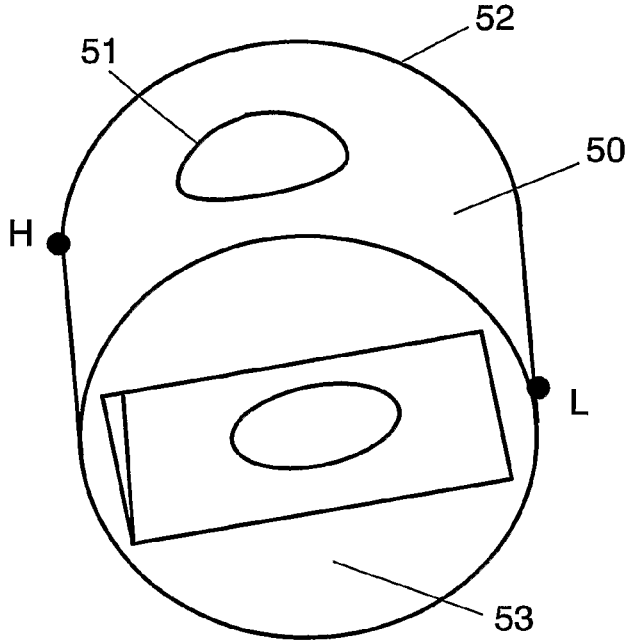
FIG. 15 shows a perspective view of a piston in a conventional compressor, as seen from above.

A compressor in accordance with the third embodiment of the present invention is described referring to the following drawings: FIG. 9 shows a vertically cross sectional view, FIG. 10 shows a horizontally cross sectional view, FIG. 11 shows a perspective view of a piston, seen from above, and FIG. 12 shows an operating behavior of the piston.

Sealed housing 301 is filled with refrigerant 315, such as isobutane (R600a), and stores oil 302, such as a relatively low viscosity mineral oil, at the bottom.

Motor element 305 is fixed to the lower part of cylinder block 312. The motor element 305 is an inverter-control motor which comprises stator 303 coupled with an inverter circuit (not shown) and rotor 304 which has a built-in permanent magnet and is fixed to the lower part of main shaft 307. The inverter circuit drives motor element 305 at a plurality of operation frequencies including those lower than the commercially available power supply frequency (e.g. 1500 r/min).

Compression element 306 is described below.

Vertically-disposed crankshaft 309 is formed of main shaft 307 and eccentric shaft 308. Crankshaft 309 has built-in oil pump 320, which pump is connected through to the top end of eccentric shaft 308 via spiral groove 317 while the bottom opening is dipped in oil 302. Cylinder block 312 supports main shaft 307 so that the shaft can revolve freely, and is provided with cylinder bore 311 for forming compression chamber 310.

Piston 350 is fitted in cylinder bore 311 so that the piston can reciprocate therein. Piston pin 314 has an approximate cylindrical shape, which is disposed in parallel to eccentric shaft 308 to be fitted in piston pin hole 351 provided in piston 350. Connection structure 313 has major connection hole 333 provided for insertion of eccentric shaft 308, minor connection hole 331 provided for insertion of piston pin 314, and rod 332 which connects eccentric shaft 308 with piston 350 by means of piston pin 314.

In the drawing of the compressor in the present embodiment, as viewed from above with crankshaft 309 at this side of a viewer, a side of the circumferential surface of piston 350 at the right in relation to the vertical cross sectional plane containing the center axis of a piston cylinder (viz. a flat plane that is parallel to the center axis) represents the compression load side, while the surface at the left is the anti-compression load side.

A circumferential surface of piston 350 is provided with hollow areas of no sliding-contact 390 so that the surface of the sliding-contact extends in the reciprocation direction of piston 350 at compression load side 360 as well as anti-compression load side 370. By making the width in the circumferential direction of the sliding-contact surface to be wider at compression load side 360 than that at anti-compression load side 370, the area of the sliding-contact surface at the compression load side can be made greater than that at the anti-compression load side.

Many of the above-described sliding components of compression element 306 are made of a cast iron, a sintered iron, a carbon steel or the like material containing iron. Connection structure 313, however, is formed with an aluminum-containing material, which is compatible with iron, for example an aluminum die cast, in view of the anti-wearing property thereof.

Operation of the above-configured compressor is described in the following.

As soon as motor element 305 is driven with electric power, rotor 304 starts revolving clockwise (as viewed from above the compressor), and crankshaft 309 revolves likewise. The revolving motion of eccentric shaft 308 is conveyed by way of connection structure 313 and piston pin 314 to piston 350, connection structure 313 oscillates with respect to piston pin 314, and piston 350 reciprocates in cylinder bore 311. As the result of reciprocation of piston 350, refrigerant 315 filling the inside of sealed housing 301 is sucked into compression chamber 310 and then compressed to be discharged to the outside of sealed housing 301. The compression and discharge cycle repeats.

When crankshaft 309 revolves, oil pump 320 sucks oil 302 and sends it to the top end of eccentric shaft 308 through spiral groove 317 to be scattered there. Oil 302 thus scattered lubricates such sliding surfaces as surfaces between minor connection hole 331 and piston pin 314, and surfaces between piston 350 and cylinder bore 311.

Now, description is made referring to FIG. 12 on the behavior of piston 350 in a compressor at the latter stage of the compression stroke; the posture of piston 350 is considered to deteriorate during this stage. FIG. 12 shows the compression element as viewed from above, with eccentric shaft 308 at this side of a viewer. Main shaft 307 revolves clockwise on its center axis O. Point S indicates the center axis of eccentric shaft 308, point Q shows center axis of piston pin 314, and circle 395 represents a locus of the center axis S of eccentric shaft 308.

Piston 350 is under the influence of compression force P; as the result, counter-clockwise revolution at minor connection hole 331 generates a substantial counter-clockwise oscillation moment 380 as indicated with an arrow mark. Meanwhile, due to the lateral vector F of compression force P, the sliding resistance f2 caused by fluid friction between the sliding-contact surface of piston 350 at compression load side 360 and cylinder bore 311 becomes greater than the sliding resistance f1 caused by fluid friction between the sliding-contact surface of piston 350 at anti-compression load side 370 and cylinder bore 311. As the result, clockwise oscillation moment 385, which is the opposite moment to counter-clockwise oscillation moment 380, arises.

In the conventional compressors, where the area of the sliding-contact surface at the compression load side and that at the anti-compression load side are identical, counter-clockwise oscillation moment 380 is greater than clockwise oscillation moment 385. Therefore, piston 350 is eventually affected by the counter-clockwise oscillation moment, and tilts left-wise in cylinder bore 311; the sliding-contact surface of piston 350 collides with cylinder bore 311 at the points corresponding to L and H. The contact as such is considered to cause the wear.

On the other hand, the width of sliding-contact surface of piston 350 at compression load side 360 in the present embodiment is made to be wider than that at anti-compression load side 370. Therefore, the sliding resistance f2 due to fluid friction between the sliding-contact surface at compression load side 360 and cylinder bore 311 becomes greater than the sliding resistance f1 due to fluid friction between the sliding-contact surface at anti-compression load side 370 and cylinder bore 311. As the result, the increased clockwise oscillation moment 385 brings about equilibrium with counter-clockwise oscillation moment 380.

Namely, clockwise oscillation moment 385 cancels counter-clockwise oscillation moment 380. There is no oscillation moment which affects piston 350; so, it is considered that a leftward tilt posture of the piston disappears because of this. Thus, piston 350 can maintain the straight posture in cylinder bore 311 during low speed operation. The wearing phenomenon resulting from unsymmetrical mechanical contact of piston 350 against cylinder bore 311, which mechanical contact is starts at the points of the sliding surface corresponding to L and H, is thus prevented.

In the study conducted by the inventors using actually operating test compressors, damage due to the unsymmetrical contact with cylinder bore 311 was hardly observed on the surface of piston 350 in the present embodiment. Furthermore, comparative testing was conducted between compressor in the present embodiment and conventional ones with respect to a number of performance values at low speed operation, among other speeds. In the test, the compressor of the present embodiment showed improvements in the average values at each of the performance items, and dispersion of the values decreased more than 50%.

As described, during the compression stage (viz. the piston is on the way from the bottom dead point to the top dead point), connection structure 313 is located at the left in relation to a reference plane, which reference plane is perpendicular to the plane of pendulum action of connection structure 313 and including center axis of piston 350. So, surface 360 represents the circumferential surface at the compression load side. By making the area of a sliding-contact surface of the piston at the compression load side 360 to be greater than that at the anti-compression load side 370, piston 350 can maintain a substantially straight posture in cylinder bore 311 during low speed operation. Thus the wear due to unsymmetrical contact of piston 350 and cylinder bore 311 can be prevented, and the efficiency of the compressor during slow speed operation can be raised and the performance stabilized. The present invention is advantageous in offering high reliability compressors at low cost.

In the present embodiment, the sliding-contact surface of piston 350 at compression load side 360 is not divided by the area of no sliding-contact 390. So, even in a case when a high pressure refrigerant is used or compression pressure within compression chamber 310 becomes high depending on operating conditions of a driving system, the film of oil existing between the sliding-contact surface at compression load side 360 and cylinder bore 311 is not broken easily. Thus the possible wear due to metallic contact of piston 350 with cylinder bore 311 may be effectively prevented.

Furthermore, the hollow area of no sliding-contact 390 provided in the circumferential surface of piston 350 reduces the amount of sliding resistance which is caused by fluid friction between piston 350 and cylinder bore 311, by a value corresponding to the hollow area. Consequently, compressor input can be suppressed to be low and the overall power consumption can be reduced.

In piston 350 of the present embodiment, the ratio in the width of the sliding-contact surface at compression load side 360 vs. the width at anti-compression load side 370 may be optimized according to the conditions in revolution frequency, compression condition, etc. presented from the system designing side.

Although compression element 306 is disposed above motor element 305 in the present embodiment, the present invention may of course be embodied in an inverse arrangement.

INDUSTRIAL APPLICABILITY

The present invention has an advantage in offering a high reliability compressor. Therefore, it is applicable to a wide range of product fields which employ the refrigeration cycle, such as domestic refrigerators, dehumidifying units, freezer showcases, automatic vending machines, etc.

The invention claimed is:

1. A compressor comprising a motor element and a compression element driven by the motor element, both elements being disposed in a housing which stores oil, the compression element comprising a crankshaft having a main shaft and an eccentric shaft coupled with the main shaft, a cylinder block which supports the main shaft so that the shaft can revolve freely, the cyclinder block being and provided with a cylinder bore for forming a compression chamber, a piston which reciprocates in the cylinder bore, and a connection structure which connects the piston with the eccentric shaft; wherein an area of a sliding-contact surface formed on the piston in the cylinder bore at a compression load side is greater than that at an anti-compression load side.

2. The compressor of claim 1, wherein a length of a circumferential surface of the piston in a reciprocation direction is longer at the compression load side as compared to that at the anti-compression load side.

3. The compressor of claim 1, wherein the piston has a piston top surface at the cylinder bore side and a piston skirt surface at the connection structure side, and the piston is provided with a hollow area of no sliding-contact in the circumferential surface.

4. The compressor of claim 3, wherein the sliding-contact surface on the circumferential surface of the piston comprises sliding-contact surface portions at an end of the piston top surface and at an end of the piston skirt surface, respectively, each of the sliding-contact surface portions having its own length from the end, whereas the hollow area of no sliding-contact is disposed in between the sliding-contact surface portions at the end of the piston top surface and that of the piston skirt surface.

5. The compressor of claim 3, wherein the sliding contact surface of the piston comprises sliding-contact surface portions extending from the piston top surface to reach the piston skirt surface at the compression load side and at the anti-compression load side, respectively, a width in a circumferential direction of the sliding-contact portion surface at compression load side being wider than that at the anti-compression load side.

6. The compressor recited in claim 1, which is driven on at least an operating frequency that is lower than the commercially available power supply frequency.

7. A compressor comprising a crankshaft formed of a main shaft and an eccentric shaft coupled with the main shaft at the upper part, a cylinder block which supports the main shaft so that the shaft can revolve freely, the cylinder clock being provided with a cylinder bore for forming a compression chamber, a piston which reciprocates in the cylinder bore, and a connection structure which connects the piston with the eccentric shaft and undergoes a pendulum action with respect to the piston; wherein a side of a circumferential surface of the piston located in the same side as the connection structure at its compression stroke, with respect to a reference plane, has a smaller sliding surface than a sliding surface located in the opposite side, the reference plane being a plane perpendicular to the pendulum action plane and includes a center axis of the piston.

8. The compressor of claim 7, wherein the piston has a piston top surface at the cylinder bore side and a piston skirt surface at the connection structure side, and the piston top surface and the piston skirt surface are not parallel to each other.

9. The compressor of claim 7, wherein the circumferential surface of the piston is provided with a surface for making sliding-contact with the cylinder bore and a hollow area which stays out of the sliding-contact.

10. The compressor recited in claim 2, which is driven on at least an operating frequency that is lower than the commercially available power supply frequency.

11. The compressor recited in claim 3, which is driven on at least an operating frequency that is lower than the commercially available power supply frequency.

12. The compressor recited in claim 4, which is driven on at least an operating frequency that is lower than the commercially available power supply frequency.

13. The compressor recited in claim 5, which is driven on at least an operating frequency that is lower than the commercially available power supply frequency.

* * * * *